US012722752B2

(12) United States Patent
Elson

(10) Patent No.: US 12,722,752 B2
(45) Date of Patent: Sep. 1, 2026

(54) BODY BOARD

(71) Applicant: Timothy Paul Elson, Pleasanton, CA (US)

(72) Inventor: Timothy Paul Elson, Pleasanton, CA (US)

(73) Assignee: Timothy Paul Elson, Pleasanton, CA (US)

( * ) Notice: Subject to any disclaimer, the term of this patent is extended or adjusted under 35 U.S.C. 154(b) by 800 days.

(21) Appl. No.: 17/803,942

(22) Filed: Jan. 27, 2023

(65) Prior Publication Data

US 2023/0399081 A1 Dec. 14, 2023

Related U.S. Application Data

(60) Provisional application No. 63/350,811, filed on Jun. 9, 2022.

(51) Int. Cl.
*B63B 34/565* (2020.01)

(52) U.S. Cl.
CPC ..... *B63B 34/565* (2020.02); *B63B 2231/50* (2013.01); *B63B 2231/52* (2013.01)

(58) Field of Classification Search
CPC ..... B63B 34/565; B63B 2231/50; B63B 2231/52; B63B 32/50; B63B 32/00; B63B 32/20
See application file for complete search history.

(56) References Cited

U.S. PATENT DOCUMENTS

| | | | | |
|---|---|---|---|---|
| 5,116,269 | A * | 5/1992 | Moran | B63B 32/22 D21/770 |
| 7,410,399 | B2 * | 8/2008 | Blumenfeld | B63B 32/57 441/65 |
| 7,798,876 | B2 * | 9/2010 | Mix | A63B 69/14 441/65 |
| 8,641,466 | B2 * | 2/2014 | Ruiz | B63B 32/30 441/68 |
| 2004/0161986 | A1 * | 8/2004 | Scozzari | B63B 32/50 441/65 |
| 2010/0273372 | A1 * | 10/2010 | Parsia | B63B 34/54 441/74 |

* cited by examiner

*Primary Examiner* — Anthony D Wiest
(74) *Attorney, Agent, or Firm* — James A. Gavney Jr; JAG Patent Services

(57) ABSTRACT

A body board or boogie board has an elongated flotation body with raised side features or a raised skirt that wraps around the front portion and portions of both sides of the elongated flotation body and protrudes upward to cradle or support a user in a recumbent position while riding waves. The body board or boogie board also has a grab-bar for manipulating the body board or boogie board while riding waves and can include one or more attachment features for securing one or more accessories to the body board or boogie board.

17 Claims, 8 Drawing Sheets

BODY BOARD

RELATED APPLICATION

This application claims priority under 35 U.S.C. § 119 (e) from the U.S. provisional patent application Ser. No. 63/350,811, filed on Jun. 9, 2022, and titled "WAVE SLED." The provisional patent application Ser. No. 63/350,811, filed on Jun. 9, 2022, and titled "WAVE SLED." is hereby incorporated by reference.

FIELD OF THE INVENTION

This invention relates to aquatic articles. More particularly, the this invention relates to body boards.

BACKGROUND OF THE INVENTION

A number of aquatic articles are available for swimming and other water activities. For example, there are snorkels, face masks, fins, goggles and boards, to name a few. There are also wet suits, swimming suits and other articles of clothing that are used by swimmers, divers and surfers alike.

Of the board products, paddle board are typically the longest (eight feet long or longer). Paddle boards are used with a paddle while a user is standing in an upright position. Surfboards are usually shorter than paddle boards (eight feet long or less) and are similar in length to the body length person surfing. Like paddle boards, surfboards are used while a user is standing in an upright position, but in this case while riding waves. Kick boards, body board and/or boogie boards are much shorter than Paddle boards or surfboards. Lengths of kick boards, body boards and/or boogie boards are more similar in length to the length of the torso of a person; less than five feet.

Kick boards are designed for and used for swim training with the upper body or torso of a user in a prone mode or a prone position with the front torso or arms stretched over and against a top surface of the kick board. Body boards or boogie boards are used and designed for body surfing wherein a user rides waves in prone mode or prone position with the front torso resting on a top surface of the body board or boogie board.

SUMMARY OF THE INVENTION

The present invention is directed to a body board or boogie board, hereafter body board, for riding waves in one or more body positions. In particular the body board of the present invention is configured to allow a user to assume a lateral recumbent position, either right of left, while riding waves and while resting on a top surface of the body board. Recumbent position refers to lying on a side portion of a person's body. The body board of the present invention is preferably five feet or less in length and three feet or less in width.

The body board of the present invention has an elongated flotation body with a front portion, a back portion, elongated sides, a top surface and a bottom surface. The body board also has raised side features or a raised skirt that wraps around the front portion and portions of both sides of the elongated flotation body. The raised side features or the raised skirt protrude upward relative to the top surface of the elongated flotation body and are preferably tapered toward the back portion of the elongated flotation body. The has raised side features or a raised skirt allow a user to enter or slide into a wave on their side in a recumbent position or with the body board angled.

The elongated flotation body can be contoured or shaped in any number of ways including being contoured or curved to form a channel on the top surface between a right side and a left side of the elongated body portion and can have a curved back portion or tail.

In further embodiments of the invention the body board has a grab structure configuration with one or more grabbing features, such as a grab-bar. The grab-bar can be secured to the raised side features or side portions of the raised skirt near the front portion of the elongated flotation body. The grab-bar is elevated a distance from the top surface of the elongated flotation body, such that a user can hold the grab-bar and manipulate and steer the body board while riding waves. The grab-bar is preferably rigid and can include a fabric sleeve, gripping features and/or padding. The elongated flotation body, the grab-bar, raised side features or the raised skirt are formed from any suitable material or combination of materials including, but not limited to, foam, plastic, aluminum, composites, fiberglass and carbon-fiber. Other grab-bar or grabbing features are envisioned. For example, the grab-bar can be bow-shaped or handle-bar shaped and be attached to the body board a one or several locations. Also, individual handles, grab loops or grab pads can be located at various positions on the raised side features, the raised skirt or the elongated flotation body. Regardless of the grab structure configuration, the grabbing structures allow the user to steer and control the body board when entering or sliding onto or into a wave and while riding the wave.

In an embodiment of the invention, the body board is formed from a foam core that is covered with a fiberglass resin, polymer or plastic. Alternatively, the body board can made of foam or a molded plastic with or without a fabric body cover.

In yet further embodiments of the invention the body board has one or more attachment features for securing one or more accessories to the elongated flotation body, the raised side features and/or raised skirt. For example, the body board can include one or more apertures through the elongated flotation body, raised side features or raised skirt and/or can include hooks, clips, pockets and the like. Suitable accessories include mesh pockets, board leashes or any other gear suitable for using the body board in an aquatic environment.

In further embodiments of the invention the body board has one or more attached or detachable tracking fins on the bottom surface of the elongated flotation body or attached or detachable stabilizing fins laterally extending out from the has raised side features or a raised skirt.

DETAILED DESCRIPTION OF THE INVENTION

Figure 1:
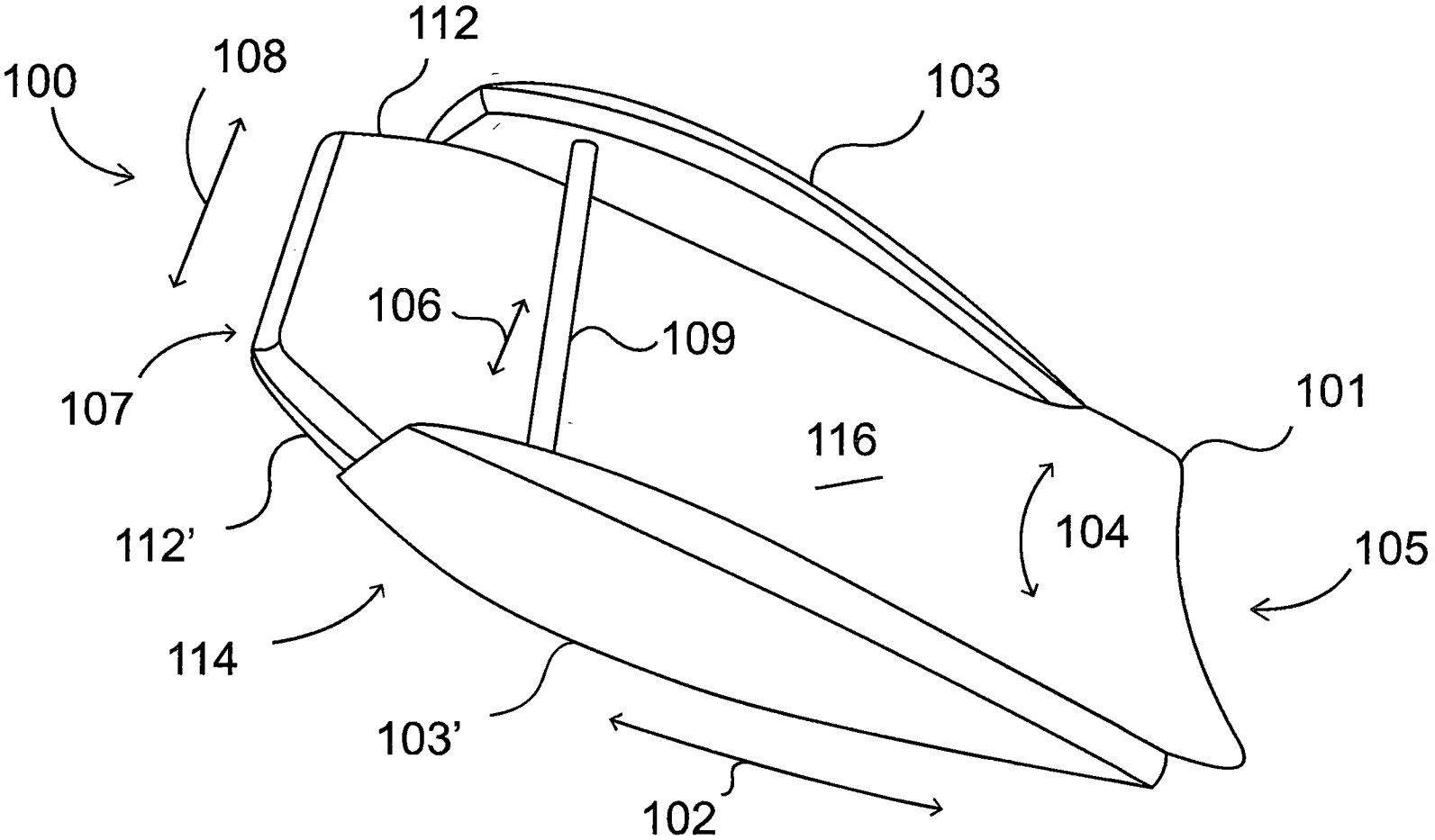
FIG. 1 illustrates a view of a body board with raised side features and a grab-bar, in accordance with the embodiments of the invention.
Figure 2A:
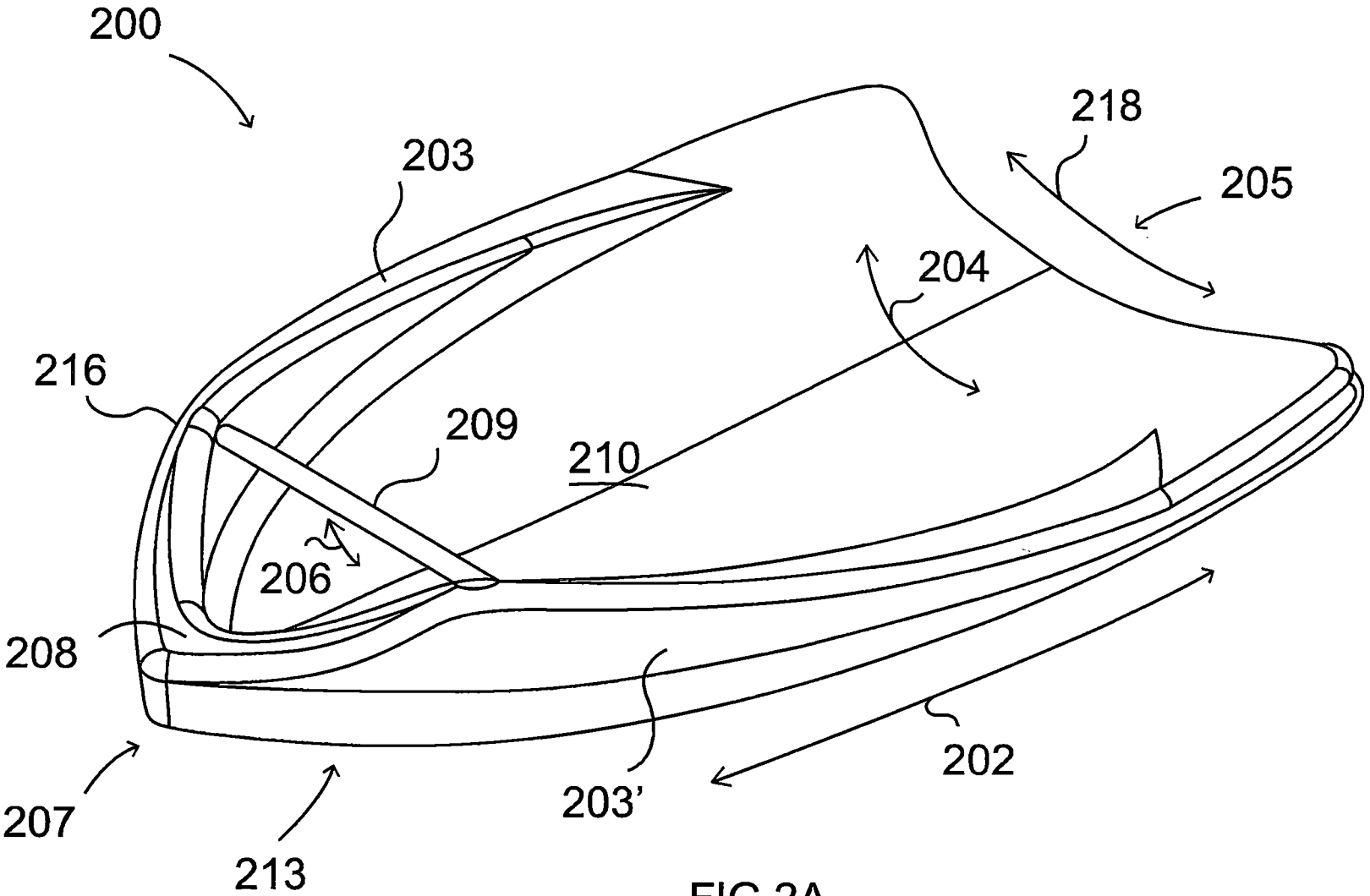
FIGS. 2A-F illustrate views of a body board with a raised skirt, a grab-bar and a tampered front portion, in accordance with a preferred embodiment of the invention.
Figure 2B:
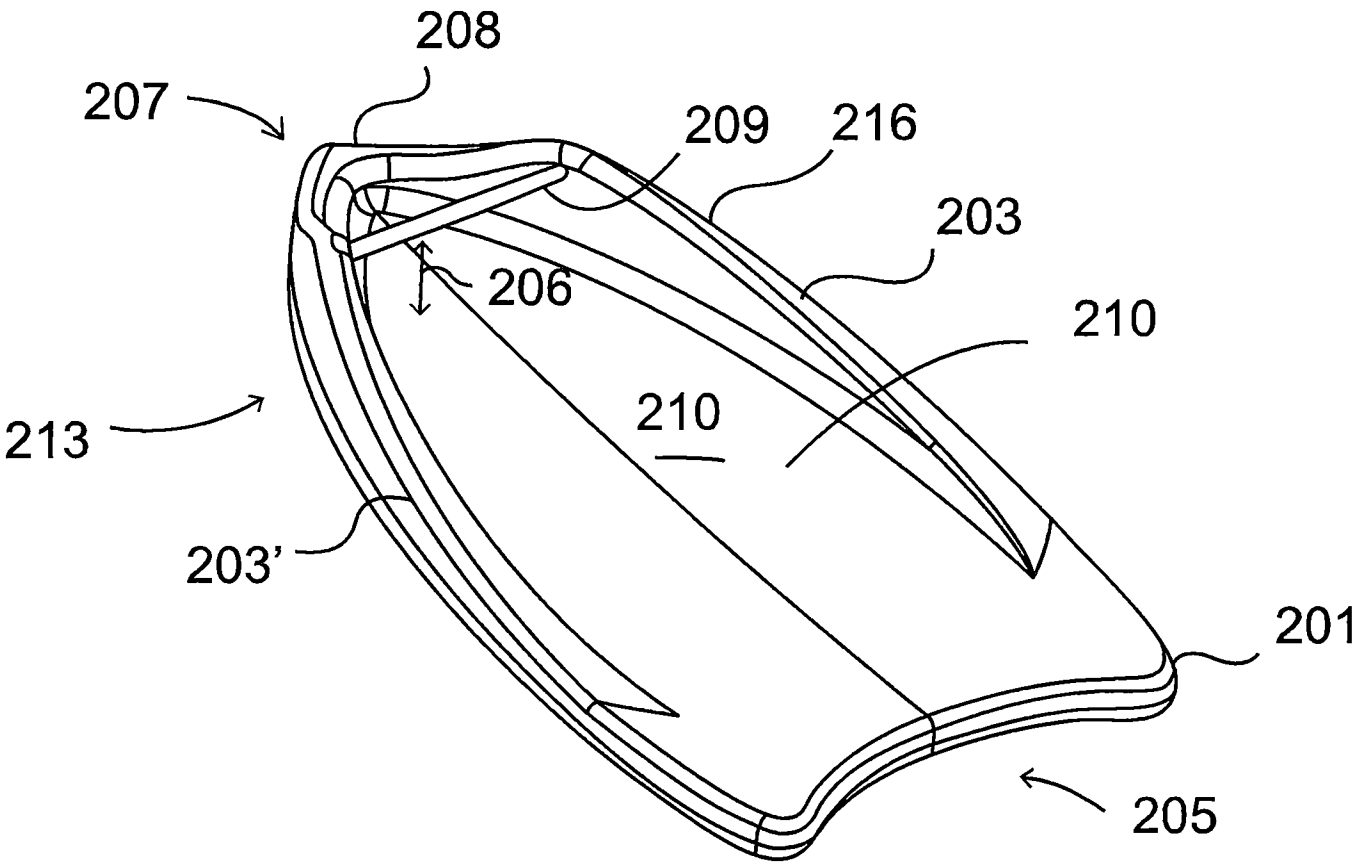
Figure 2C:
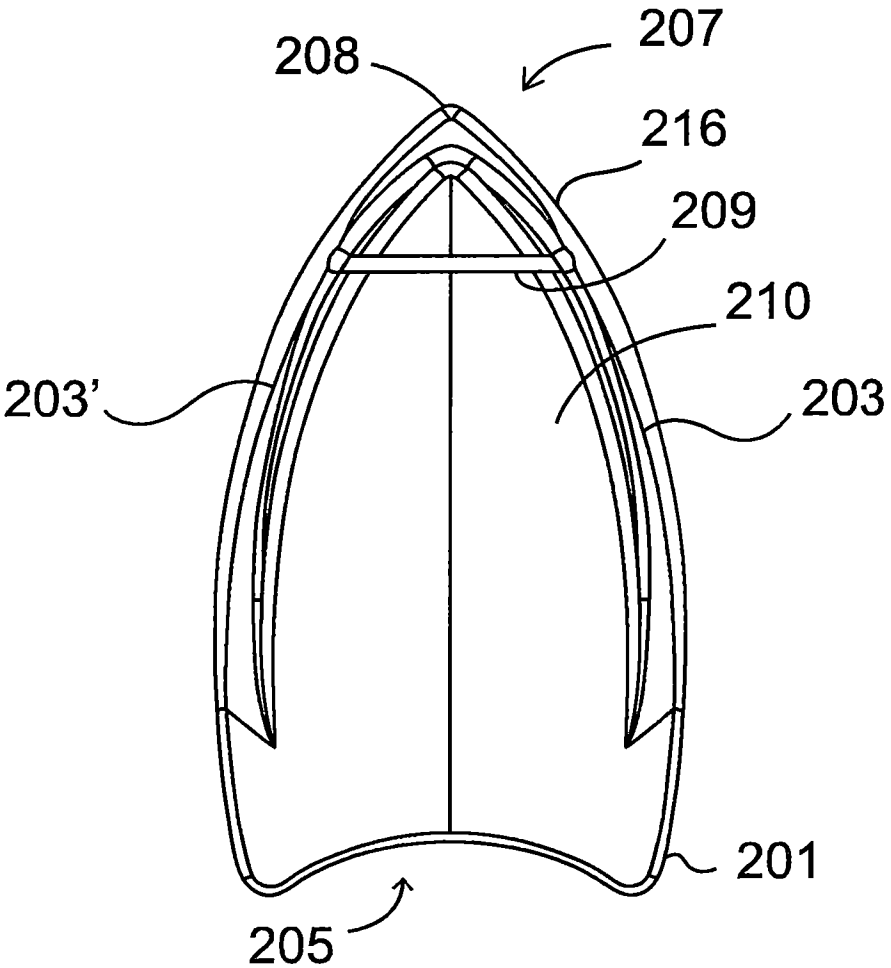
Figure 2D:
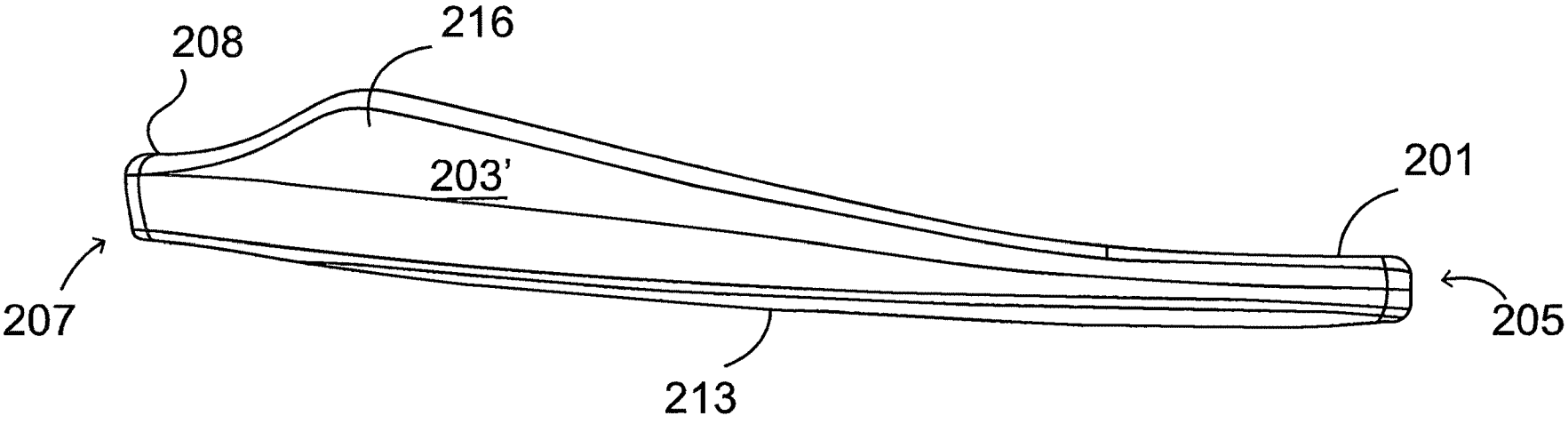
Figure 2E:
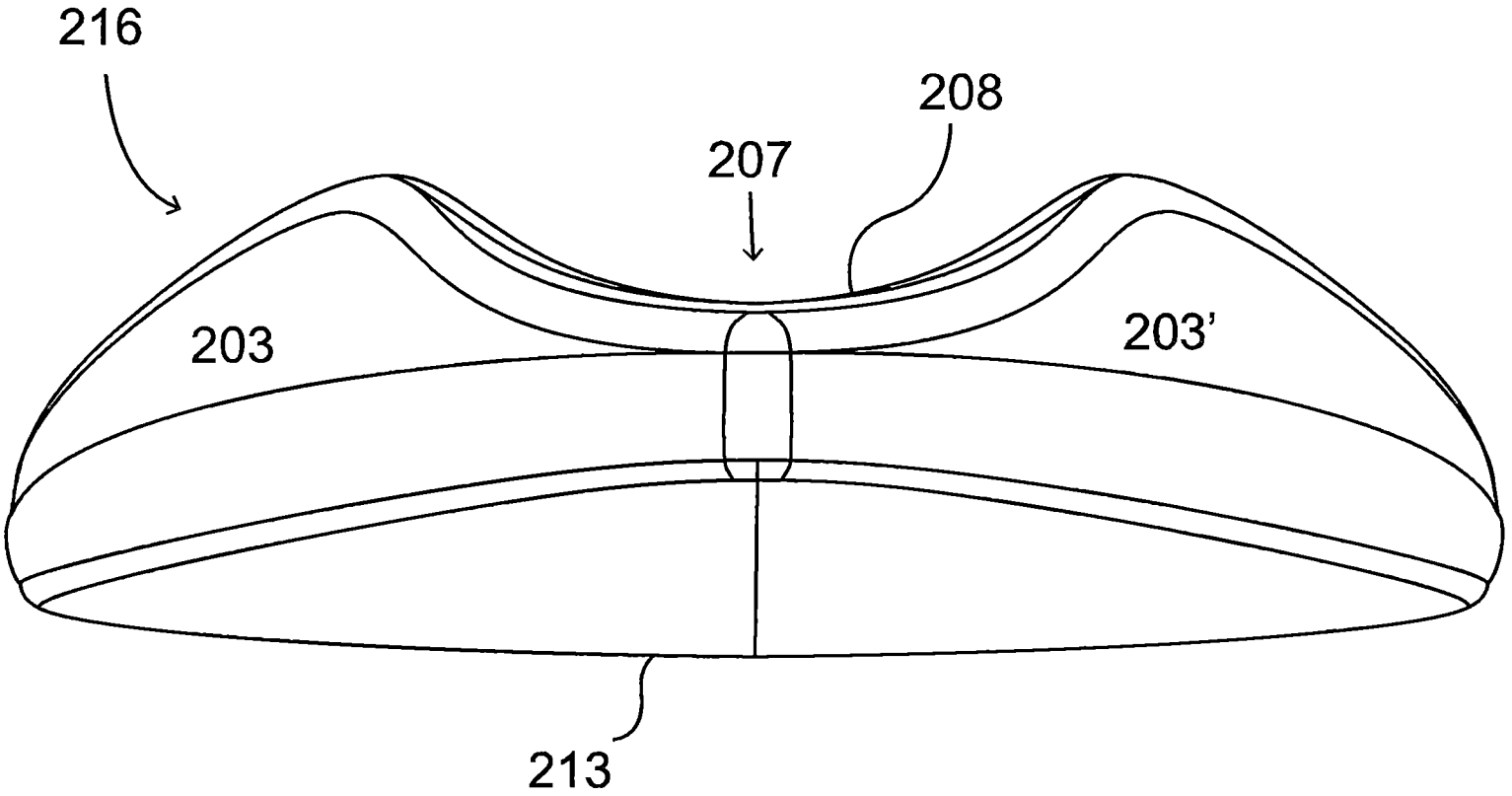
Figure 2F:
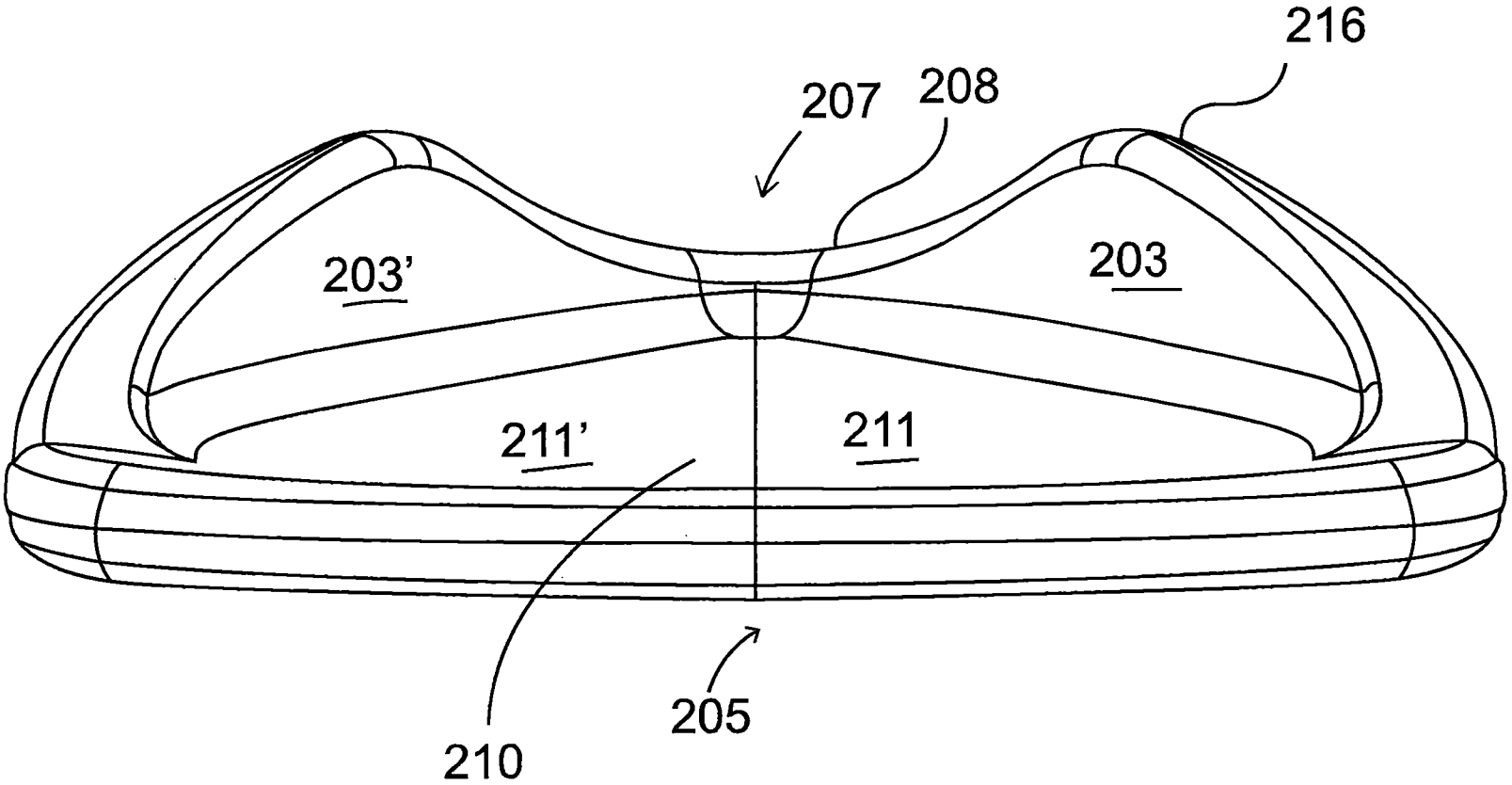

FIG. 1 illustrate a view of a body board 100 with an elongated flotation body 101 with a front portion 107, a back portion 105, elongated edges or sides 112/112', a top surface 116 and a bottom surface 114. The elongated flotation body 101 can have any number of shapes. In accordance with an embodiment back portion 105 of the elongated flotation body 101 is curved as shown.

The body board 101 is preferably five feet or less in length 102 and three feet or less in width 108 and is formed form any number suitable materials or combination of materials. For example, the body board 100 can be formed with a foam core that is covered with a fiberglass resin, polymer or plastic. Alternatively, the body board 100 can made of foam and can include a fabric cover or can be made of a molded plastic.

The body board 100 also has raised side features 103 and 103' attached along portions of the elongated edges or sides 112/112' and that protrude upward relative to the top surface 116. The elongated flotation body 101 is contoured or curved, as indicated by the arrow 104 to form a channel on the top surface 116 between the raised side features 103 and 103'.

Preferably the raised side features 103 and 103 are wedge shaped and protrude upward relative to the top surface 116 a greater distance near the front portion 107 of the elongated flotation body 101 and protrude upward relative to the top surface 116 a lesser distance near the back portion 105 of the elongated flotation body 101, as shown.

The body board also has a grab-bar 109 attached to the raised side features 103 and 103' near the front portion 107 of the elongated flotation body 101. The grab-bar 109 is elevated a distance 106 from the top surface 116 of the elongated flotation body 101 so that a user can hold the grab-bar 109 and manipulate the body board 100 while riding waves. The grab-bar 109 is preferably formed from a plastic, such PVC pipe, composite materials, fiberglass, carbon fiber, aluminum or any combination thereof. The grab-bar 109 can include gripping pads and/or a fabric sleeve with or without gripping features and/or padding.

FIGS. 2A-F illustrate views of a body board 200 with an elongated flotation body 201 having a tapered or pointed front portion 207, a contoured back portion 205, a top surface 210 formed from a right side 211 and a left side 211' and a bottom surface 213. The elongated flotation body 201 is preferably contoured or curved to form a channel 204 on the top surface 210 between the right side 211 and the left side 211' of the elongated flotation body 201. The body board 200 also preferably includes a raised skirt 216 that wraps around the tapered or pointed front portion 207 and portions of both sides of elongated flotation body 201 and that protrudes upward relative to the top surface 210. The raised skirt 216 preferably has a depression 208 near the front portion 207 of the elongated flotation body 201. Raised side features 203 and 203' of the raised skirt 216 preferably taper to protrude upward relative to the top surface 210 to a lesser distance toward the back portion 205 of the elongated flotation body 201.

The body board 200 is preferably five feet or less in length 202 and three feet or less in width 218 and formed form any number suitable materials or combination of materials. For example, the body board 200 can be made of a foam core that is covered with a fiberglass resin, polymer or plastic. Alternatively, the body board 200 can made of foam and can include a fabric cover or can be made of a molded plastic.

The body board 200 also has grab-bar 209 attached to the raised side features 203 and 203' of the raised skirt 216 near the front portion 207 of the elongated flotation body 201. The grab-bar 209 is elevated a distance 206 from the top surface 210 of the elongated flotation body 201 so that a user can hold the grab-bar 209 and manipulate the body board while riding waves. The grab-bar 209 is preferably formed from a plastic, such a PVC pipe, composite materials, fiberglass, carbon fiber, aluminum or any combination thereof. The grab-bar 209 can include gripping pads and/or a fabric sleeve with or without gripping features and/or padding.

It will be clear to one skilled in the art that the elongated flotation body 101, raised side features 103 and 103' and grab-bar 109 described with reference to FIG. 1 and the elongated flotation body 201, the raised skirt 216 and the grab-bar 209, described with reference to FIGS. 2A-F can be made from different materials, formed as a single unit (monolithic) or formed in parts that are assembled.

Figure 3:
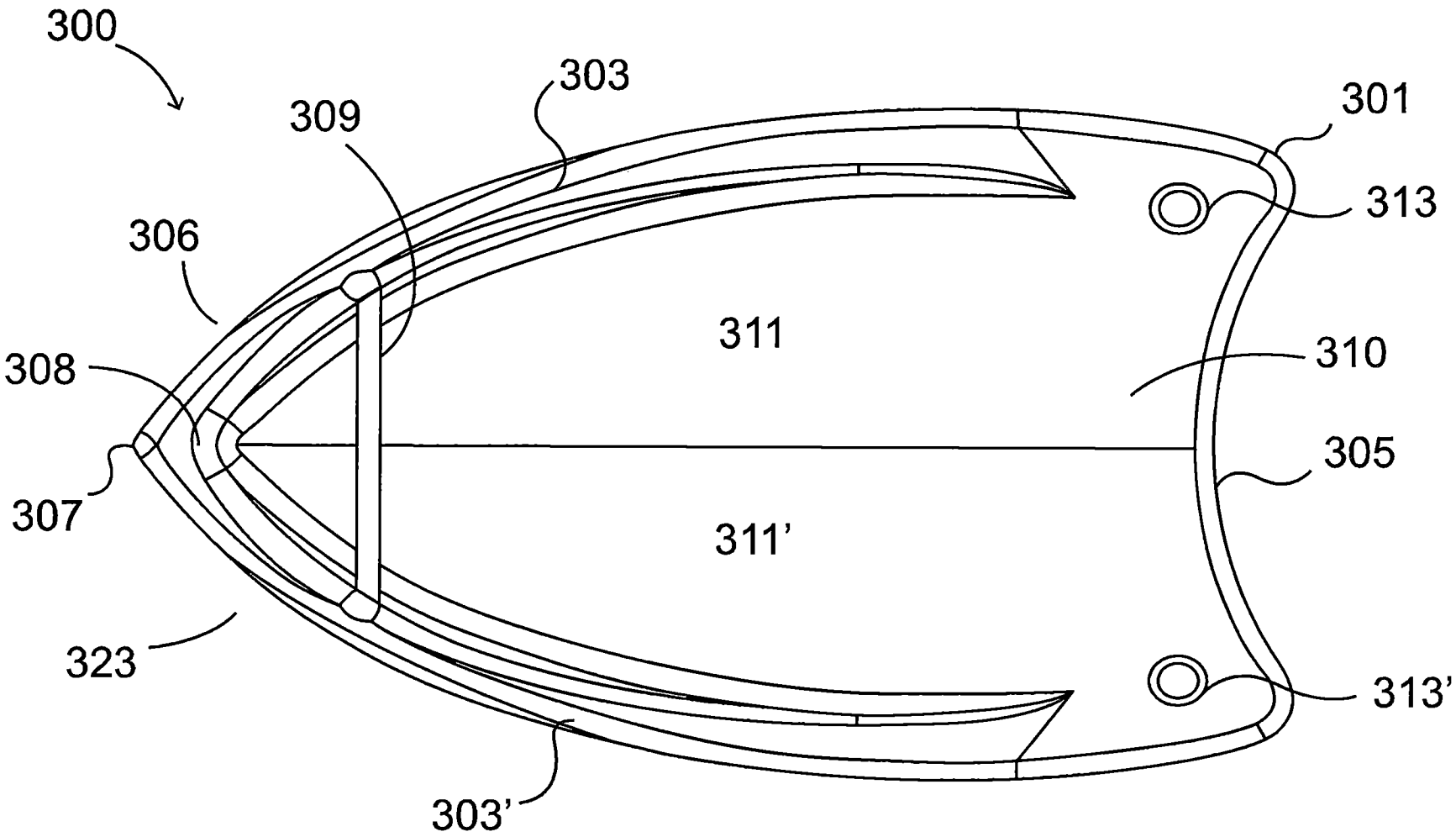
FIG. 3 shows a view of a body board with raised skirt, a grab-bar, a tampered front portion and anchor or attachment features, in accordance with a preferred embodiment of the invention.

FIG. 3 shows a body board 300 similar in structure and materials to the body board 200 described above with reference to FIGS. 2A-F. The body board 300 has an elongated flotation body 301 with tapered or pointed front portion 307, a contoured back portion 305, a top surface 310 formed from a right side 311 and a left side 311' and a bottom surface 323. The elongated flotation body 301 is preferably contoured or curved to form a channel on the top surface 310 between a right side 311 and a left side 311' of the elongated flotation body 301. The body board 300 has a raised skirt 306 that wraps around the tapered or pointed front portion 307 and portions of both sides of elongated flotation body 301. The raise skirt 306 has a depression 308 near the front portion 307 and protruding sides 303 and 303' that taper toward the back portion 305 of the elongated flotation body 301.

The body board 300 has dimensions that are within the parameters described above with reference to the body board 200 (FIGS. 2A-F). The body board 300 as has a grab-bar 309 attached to the raised side features 303 and 303' near the front portion 307 of the body board 300.

The elongated flotation body 301, the raised skirt 306 and the grab-bar 309 are formed from any suitable material or combinations of materials including, but not limited to, foam, fiberglass, plastic, composite materials, carbon fiber and any combination thereof.

The body board 300 has one or more attachment features 313 and 313' for securing one or more accessories to the body board 300. For example, the body board 300 can include one or more apertures on the elongated flotation body 310, the raised side features 303/303' or the raised skirt 306 and/or can include hooks, clips, and the like. Accessories include mesh pockets, board leashes or any other gear suitable for using body board 300 in an aquatic environment The present invention has been described in terms of specific embodiments incorporating details to facilitate the understanding of the principles of construction and operation of the invention. For example, the body board can have any number of suitable shapes or configurations. As such, references herein to specific embodiments and details thereof are not intended to limit the scope of the claims appended hereto. It will be apparent to those skilled in the art that modifications can be made in the embodiments chosen for illustration without departing from the spirit and scope of the invention.

What is claimed is:

1. A body board comprising:

a) an elongated flotation body with a front portion, a back portion, a right elongated side, a left elongated side, a top surface and a bottom surface;

b) a right raised side feature and a left raised side feature attached along corresponding edge portions of the right elongated side and the left elongated side and protruding upward relative to the top surface; and c) a linear grab-bar with one end of the linear grab-bar attached to the right raised side feature and one end of the linear grab-bar attached to the left raised side feature, wherein the grab-bar is elevated a distance from the top surface of the elongated flotation body and extends between the right elongated side and the left elongated side.

2. The body board of claim 1, wherein the elongated flotation body is contoured or curved to form a channel on the top surface between a right side and a left side of the elongated body portion.

3. The body board of claim 1, wherein the right raised side feature and the left raised side feature are wedge shaped and taper towards the back portion of the elongated flotation body.

4. The body board of claim 1, further comprising one or more attachment features for securing one or more accessories to the body board.

5. The body board of claim 1, wherein the back portion of the elongated flotation body is curved and the front portion of the elongated flotation body is tampered.

6. The body board of claim 1, wherein the elongated flotation body the right raised side feature and the left raised side feature are made from one or more material selected from the group comprising foam, fiberglass, polymer resin, and plastic.

7. The body board of claim 1, wherein the elongated flotation body is five feet or less in length and three feet or less in width.

8. A body board comprising:

a) an elongated flotation body with tapered or pointed front portion, a back portion, a top surface and a bottom surface;

b) a raised skirt that wraps around the tapered or pointed front portion and portions of both right and left sides of the elongated flotation body and that protrudes upward relative to the top surface; and c) a grab-bar connected to portions of the raised skirt and extending between the right and left sides of the elongated flotation body.

9. The body board of claim 8, wherein the elongated flotation body is contoured or curved to form a channel on the top surface between a right side and a left side of the elongated body.

10. The body board of claim 8, wherein the raised sides of the raised skirt taper towards the back portion of the elongated flotation body.

11. The body board of claim 8, further comprising one or more attachment features for securing one or more accessories to the body board.

12. The body board of claim 8, wherein the back portion of the elongated flotation body is curved.

13. The body board of claim 8, wherein portions of the body board are made from one or more material selected form the group comprising of foam, fiberglass, polymer and plastic.

14. The body board of claim 8, wherein body board is five feet or less in length and three feet or less in width.

15. A body board comprising:

a) an elongated flotation body with tapered or pointed front portion, a back portion, a top surface and a bottom surface;

b) a raised skirt that wraps around the tapered or pointed front portion and portions of both right and left sides of elongated flotation body and protrudes upward relative to the top surface, wherein the raised skirt tapers towards the back portion of the elongated flotation body; and c) a grab-bar connected to portions of the raised skirt near the tapered or pointed front portion of the elongated flotation body, wherein the grab-bar is elevated a distance from the top surface of the elongated flotation body and extending between right and left sides of elongated flotation body.

16. The body board of claim 15, further comprising attachment features for securing one or more accessories to the elongated flotation body.

17. The body board of claim 15, wherein portions of the body board is made from one or more material selected from the group consisting of foam, fiberglass and plastic and wherein the body board is five feet or less in length and three feet or less in width.

* * * * *